US008214201B2

(12) United States Patent
Sun

(10) Patent No.: US 8,214,201 B2
(45) Date of Patent: Jul. 3, 2012

(54) PITCH RANGE REFINEMENT

(75) Inventor: Xuejing Sun, Rochester Hills, MI (US)

(73) Assignee: Cambridge Silicon Radio Limited, Cambridge (GB)

( * ) Notice: Subject to any disclaimer, the term of this patent is extended or adjusted under 35 U.S.C. 154(b) by 734 days.

(21) Appl. No.: 12/274,061

(22) Filed: Nov. 19, 2008

(65) Prior Publication Data

US 2010/0125452 A1 May 20, 2010

(51) Int. Cl.
*G10L 11/04* (2006.01)

(52) U.S. Cl. ..... 704/207; 704/208; 704/216; 704/217; 704/218

(58) Field of Classification Search ..... 704/208, 704/207, 216, 217, 218
See application file for complete search history.

(56) References Cited

U.S. PATENT DOCUMENTS

| | | | | |
|---|---|---|---|---|
| 5,699,485 | A * | 12/1997 | Shoham | 704/223 |
| 7,593,852 | B2 * | 9/2009 | Gao et al. | 704/233 |
| 2002/0007273 | A1 * | 1/2002 | Chen | 704/229 |
| 2002/0123887 | A1 * | 9/2002 | Unno | 704/220 |
| 2003/0220787 | A1 * | 11/2003 | Svensson et al. | 704/207 |
| 2004/0184443 | A1 * | 9/2004 | Lee et al. | 370/352 |
| 2008/0046252 | A1 * | 2/2008 | Zopf et al. | 704/501 |

OTHER PUBLICATIONS

Dima Feldman and Yuval Shavitt, An Optimal Median Calculation Algorithm for Estimating Internet Link Delays From Active Measurements, Tel-Aviv University, Ramat Aviv 69978, Israel May 21, 2007.

Henrik Svensson and Victor Öwall, Implementation Aspects of a Novel Speech Packet Loss Concealment Method, Department of Electroscience, Lund University, SE-221 00 Lund, Sweden, IEEE 2005.

Colin Perkins, Orion Hodson, and Vicky Hardman, A Survey of Packet Loss Recovery Techniques for Streaming Audio, University College London, IEEE 1998.

Telecommunication Standardization Sector of International Telecommunication Union, G.711:Transmission Systems and Media, Digital Systems and Networks, Appendix I: A High Quality Low-Complexity Algorithm for Packet Loss Concealment With G.711, Sep. 1999.

William H. Press, Saul A. Teukolsky, William T. Vetterling, Brian P. Flannery, Numberical Recipes in C. The Art of Scientific Computing, 2nd Edition, 1992, Chapter 8, pp. 341-345.

* cited by examiner

*Primary Examiner* — Qi Han
(74) *Attorney, Agent, or Firm* — Greenberg Traurig, LLP

(57) ABSTRACT

A method of refining a pitch period estimation of a signal, the method comprising: for each of a plurality of portions of the signal, scanning over a predefined range of time offsets to find an estimate of the pitch period of the portion within the predefined range of time offsets; identifying the average pitch period of the estimated pitch periods of the portions; determining a refined range of time offsets in dependence on the average pitch period, the refined range of time offsets being narrower than the predefined range of time offsets; and for a subsequent portion of the signal, scanning over the refined range of time offsets to find an estimate of the pitch period of the subsequent portion.

26 Claims, 2 Drawing Sheets

PITCH RANGE REFINEMENT

FIELD OF THE DISCLOSURE

This disclosure relates to estimating the pitch period of a voice signal, in particular to refining a prior candidate for such an estimation. The present disclosure is particularly applicable for refining an estimation of the pitch period of a voice signal for use in packet loss concealment methods.

BACKGROUND

Wireless and voice-over-internet protocol (VoIP) communications are subject to frequent loss of packets as a result of adverse connection conditions. Such lost packets result in clicks and pops or other artifacts being present in the output voice signal at the receiving end of the connection. This degrades the perceived speech quality at the receiving end and may render the speech unrecognizable if the packet loss rate is sufficiently high.

Broadly speaking, two approaches are taken to combat the problem of lost packets. The first approach is the use of transmitter-based recovery techniques. Such techniques include retransmission of lost packets, interleaving the contents of several packets to disperse the effect of packet loss, and addition of error correction coding bits to the transmitted packets such that lost packets can be reconstructed at the receiver. In order to limit the increased bandwidth requirements and delays inherent in these techniques, they are often employed such that packet loss can be recovered if the packet loss rate is low, but not all packet loss can be recovered if the packet loss rate is high. Additionally, some transmitters may not have the capacity to implement transmitter-based recovery techniques.

The second approach taken to combating the problem of lost packets is the use of receiver-based concealment techniques. Such techniques are generally used in addition to transmitter-based recovery techniques to conceal any remaining losses left after the transmitter-based recovery techniques have been employed. Additionally, they may be used in isolation if the transmitter is incapable of implementing transmitter-based recovery techniques. Low complexity receiver-based concealment techniques such as filling in a lost packet with silence, noise, or a repetition of the previous packet are used, but result in a poor quality output voice signal. Regeneration based schemes such as model-based recovery (in which speech on either side of the lost packet is modeled to generate speech for the lost packet) produce a very high quality output voice signal but are highly complex, consume high levels of power and are expensive to implement. In practical situations interpolation-based techniques are preferred. These techniques generate a replacement packet by interpolating parameters from the packets on one or both sides of the lost packet. These techniques are relatively simple to implement and produce an output voice signal of reasonably high quality.

Pitch based waveform substitution is a preferred interpolation-based packet loss recovery technique. The pitch period of the voiced packets on one or both sides of the lost packet is estimated. A waveform of the estimated pitch period is then repeated and used as a substitute for the lost packet. This technique is effective because voice signals appear to be composed of a repeating segment when viewed over short time intervals. Consequently, the pitch period of the lost voice packet will normally be substantially the same as the pitch period of the voice packets on either side of the lost packet.

Many methods are used to estimate the pitch period of a voice signal. Generally speaking, these methods include use of a normalized cross-correlation (NCC) method. Such a method can be expressed mathematically as:

$$NCC_t(\tau) = \frac{\sum_{n=-N/2}^{(N/2)-1} x[t+n]x[t+n-\tau]}{\sqrt{\sum_{n=-N/2}^{(N/2)-1} x^2[t+n] \sum_{n=-N/2}^{(N/2)-1} x^2[t+n-\tau]}} \quad \text{(equation 1)}$$

where x is the amplitude of the voice signal and t is time. The equation represents a correlation between two segments of the voice signal which are separated by a time $\tau$. Each of the two segments is split up into N samples. The nth sample of the first segment is correlated against the respective nth sample of the other segment.

This equation essentially takes a first segment of a signal (marked A on FIG. 1) and correlates it with each of a number of further segments of the signal (for ease of illustration only three, marked B, C and D, are shown on FIG. 1). Each of these further segments lags the first segment along the time axis by a lag value ($\tau_1$ for segment B, $\rho_2$ for segment C). The calculation is carried out over a range of lag values within which the pitch period of the voice signal is expected to be found. The term on the bottom of the fraction in equation 1 is a normalizing factor. The lag value $\tau_{NCC}$ that maximizes the NCC function represents the time interval between the segment A and the segment with which it is most highly correlated (segment D on FIG. 1). This lag value $\tau_{NCC}$ is taken to be the pitch period of the signal.

Calculation of the normalized cross-correlation accounts for over 90% of the algorithmic complexity in typical pitch based waveform substitution techniques. Although the complexity level of the calculation is low, it is significant for low-power platforms such as Bluetooth. In order to correctly determine the pitch period of a voice signal, a wide predefined pitch period range (range of lag values) is usually used, for example from 2 ms (for a person with a high voice) to 20 ms (for a person with a low voice). For most pitch determination algorithms, the wider the pitch period range used, the higher the computational complexity.

One way to reduce the computational complexity is to reduce the number of calculations that the algorithm computes. U.S. patent application Ser. No. 10/394,118 proposes to reduce the number of calculations by dynamically adapting the time interval between successive segments that are correlated with the first segment. (In the illustration of FIG. 1, the time interval between successive segments B and C is $\tau_2$-$\tau_1$.) If the correlation decreases, then the time interval to the next segment to be correlated is increased. Conversely, if the correlation increases, then the time interval to the next segment is decreased. This method evaluates the correlation over the same range of pitch periods (for example from 2 ms-20 ms) as methods in which the time interval between successive segments is constant, but advantageously this method is less computationally complex because it carries out fewer calculations by skipping over segments that it considers unlikely to lag the first segment by the pitch period. However, this method is sensitive to local pitch errors. For example, if an error leads to the correlation decreasing just before the pitch period lag value is computed, then the time interval to the next segment may be increased resulting in the algorithm skipping over the pitch period lag value. The accuracy of the estimated pitch period may suffer as a result. Additionally, this method may have difficulty handling voice signals with rapid local pitch variations.

A further problem with pitch based waveform substitution techniques is that they are prone to pitch doubling and pitch halving errors. Pitch halving occurs when the pitch period is determined to be about double its actual length. This may occur, for example with the method described by U.S. Ser. No. 10/394,118 if the peak best correlated with the peak in the first segment were to be skipped over.

Pitch doubling occurs when the pitch period is determined to be about half its actual length. This may happen in the following situation. Voice signals often have two similar peaks per pitch period that are highly correlated with each other. For example, on FIG. 1 the peaks marked 1 and 2 are highly correlated. These could be mistaken for being the same feature present in consecutive pitch periods and hence the time interval between them could be computed to be the estimated pitch period of the signal. Pitch doubling is particularly problematic for packet loss concealment applications because the replacement signal used for the lost packet will be at a non-integer multiple of the pitch period of the lost packet.

Techniques for reducing pitch doubling and pitch halving errors have been proposed, for example frequency domain and statistical techniques and post processing techniques. However these techniques incur additional computational complexity and cost.

There is thus a need for an improved method of estimating the pitch period of a signal that reduces the computational complexity associated with the estimation, and that additionally reduces susceptibility to pitch doubling and pitch halving errors without incurring extra algorithmic complexity.

SUMMARY

According to a first aspect of the disclosure, there is provided a method of refining a pitch period estimation of a signal, the method comprising: for each of a plurality of portions of the signal, scanning over a predefined range of time offsets to find an estimate of the pitch period of the portion within the predefined range of time offsets; identifying the average pitch period of the estimated pitch periods of the portions; determining a refined range of time offsets in dependence on the average pitch period, the refined range of time offsets being narrower than the predefined range of time offsets; and for a subsequent portion of the signal, scanning over the refined range of time offsets to find an estimate of the pitch period of the subsequent portion.

Preferably, the method further comprises detecting voiced and unvoiced segments of the signal, and selecting the plurality of portions of the signal from the voiced segments.

Suitably, the determining step of the method comprises selecting the lowest value and highest value of the refined range of time offsets to be proportional to the average pitch period. The lowest value may be selected to be 0.67 times the average value, and the highest value may be selected to be 1.5 times the average value.

Preferably, the method further comprises generating a waveform having a pitch period equal to the estimated pitch period of one of the plurality of portions or the subsequent portion, and replacing a lost or corrupted segment of the signal with the waveform.

Suitably, the method further comprises storing the estimated pitch periods of the plurality of portions of the signal in a buffer as they are found, and identifying the average pitch period when the buffer reaches its storing capacity.

Suitably, for each of the plurality of portions and the subsequent portion, the step of finding an estimate of the pitch period of the portion comprises: correlating a first part of the portion of the signal with each of n earlier parts of the portion of the signal, the n earlier parts preceding the first part by respective time offsets; and estimating the pitch period of the portion of the signal to be the time offset at which the correlation is maximal.

Suitably, the method further comprises estimating the pitch periods of further subsequent portions of the signal by scanning over the refined range of time offsets.

Suitably, the method further comprises periodically repeating the above pitch period estimation refinement method (i.e., the method of the first paragraph of this Summary) on the signal.

According to a second aspect of the disclosure, there is provided a pitch period estimation apparatus, comprising: a pitch period estimation module configured for each of a plurality of portions of a signal to scan over a predefined range of time offsets to find an estimate of the pitch period of the portion within the range of time offsets; a average determination module configured to identify the average pitch period of the estimated pitch periods of the portions; and a time offset range adaptation module configured to determine a refined range of time offsets in dependence on the average pitch period, the refined range of time offsets being narrower than the predefined range of time offsets; wherein the pitch period estimation module is further configured for a subsequent portion of the signal to scan over the refined range of time offsets to find an estimate of the pitch period of the subsequent portion.

Preferably, the apparatus further comprises a voice detection module configured to detect voiced and unvoiced segments of the signal and output the voiced segments to the pitch period estimation module.

Preferably, the apparatus further comprises a concealment module configured to receive the estimated pitch period of one of the plurality of portions or the estimated pitch period of the subsequent portion from the pitch period estimation module and generate a waveform having a pitch period equal to the received estimated pitch period and replace a lost or corrupted segment of the signal with the waveform.

Suitably, the concealment module is further configured to receive an unvoiced segment from the voice detection module, and replace a lost segment of the signal with the unvoiced segment.

Suitably, the apparatus further comprises a buffer configured to store the estimated pitch periods of the plurality of portions of the signal.

BRIEF DESCRIPTION OF THE DRAWINGS

The present disclosure will now be described by way of example with reference to the accompanying drawings. In the drawings.

DETAILED DESCRIPTION

Figure 2:
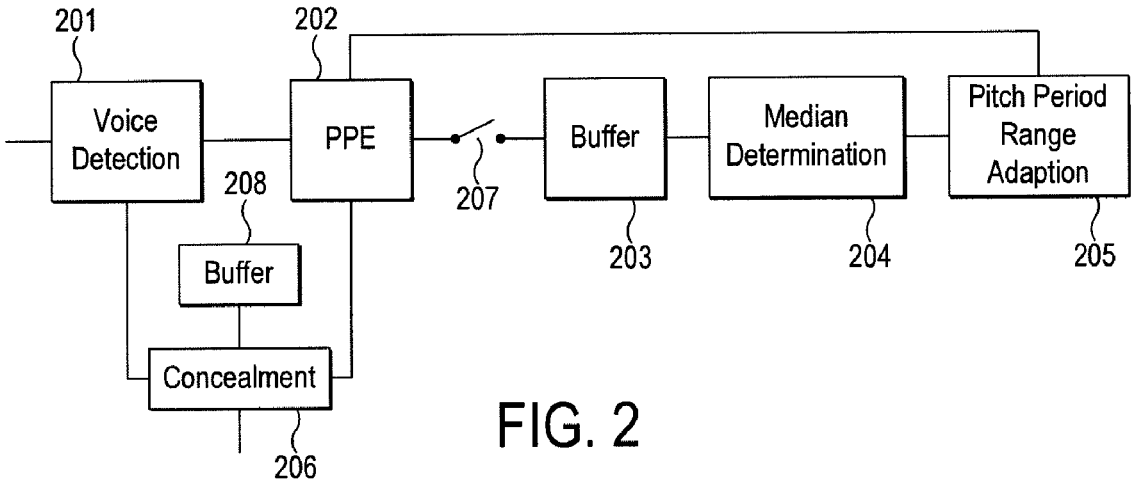
FIG. 2 is a schematic diagram of a pitch period estimation apparatus designed to refine the pitch period range used in the estimation process.

FIG. 2 shows a schematic diagram of the general arrangement of a pitch period estimation apparatus suitable for use as part of a packet loss concealment apparatus.

The pitch period estimation apparatus comprises a voice detection module 201. An output of the voice detection module is connected to an input of a pitch period estimation module 202. A further output of the voice detection module is connected to an input of a concealment module 206. An output of the pitch period estimation module is connected to the input of a buffer 203. A further output of the pitch period estimation module is connected to a further input of the concealment module 206. The output of the buffer 203 is connected to an input of a median determination module 204. The output of the median determination module 204 is connected to an input of a pitch period range adaptation module 205. The output of the pitch period range adaptation module 205 is connected to a further input of the pitch period estimation module 202. A switch 207 between the pitch period estimation module 202 and the buffer 203 allows for the feedback loop to the pitch period estimation module 202 to be disconnected.

In operation, signals are processed by the pitch period estimation apparatus of FIG. 2 in discrete temporal parts. Suitably, a speech signal is processed in frames of the order of a few milliseconds in length. Due to the intermittent nature of speech, many of these frames comprise silence or noise rather than speech. Those frames that comprise speech are referred to as voiced frames and those that don't are referred to as unvoiced frames. If an unvoiced speech packet is lost then it can be advantageously concealed by a less complex method than pitch based waveform substitution, for example by repeating previous unvoiced frames, replacing the packet with noise or replacing it with silence. If a voiced speech packet is lost then pitch based waveform substitution is a preferable method of concealment.

Each frame of a speech signal is input sequentially into a voice detection module 201. The voice detection module 201 classifies the frame as either voiced or unvoiced. This classification can be achieved using a number of well-known methods. For example, the energy of the frame can be measured and compared to a threshold. If the energy exceeds the threshold then the frame is classified as voiced. Otherwise the frame is classified as unvoiced. Alternatively, the number of zero-crossings of the signal in the frame can be measured and compared to a threshold. If the number of zero-crossings exceeds a threshold number then the frame is assumed to be unvoiced. Otherwise the frame is classified as voiced. A further alternative is to compare the minima and maxima of a cross-correlation function. A cross-correlation function is advantageously carried out when estimating the pitch period of the frame in the pitch period estimation module 202. The difference between the maximum value of the cross-correlation function and the minimum value of the cross-correlation function is measured. This difference is expected to be greater for a voiced frame than an unvoiced frame. The disadvantage of using a cross-correlation function to classify the signal as voiced or unvoiced is that it incurs extra algorithmic complexity compared to the other methods.

If a frame is unvoiced, then the voice detection module 201 outputs it to the concealment module 206. If a speech packet next to the unvoiced frame is lost, then the concealment module 206 replaces the speech packet by repeating the unvoiced frame for the duration of the lost packet. Alternatively, one of the other methods previously mentioned may be used.

If the frame is voiced, then the voice detection module 201 outputs it to the pitch period estimation module 202. The pitch period estimation module 202 estimates the pitch period of the voiced frame. Any suitable algorithm may be used. For example, the normalized cross-correlation method described in the background to this disclosure may be suitably employed.

The pitch period estimation apparatus operates in two modes: a calibration mode and a normal mode. The pitch period estimation module 202 uses the same algorithm to estimate the pitch period of a frame in both modes, but uses a different pitch period range in each mode.

In the calibration mode, the pitch period estimation module 202 uses a wide pre-defined pitch period range, for example from 2 ms to 20 ms. This range is intended to cover the normal range of pitch periods for human speech. If the normalized cross-correlation method described in the background to this disclosure is used, then this corresponds to correlating the first segment (A on FIG. 1) against further segments that lag the first segment by lag values $\tau$ ranging from 2 ms to 20 ms. The pitch period is estimated to be the lag value between 2 ms and 20 ms that maximizes the NCC function of equation 1 for the voiced frame.

In the calibration mode, the estimated pitch periods are outputted to the concealment module 206. If a packet is lost next to the voiced frame, then the concealment module 206 generates a waveform at the estimated pitch period of the voiced frame and repeats this waveform as a substitute for the lost packet. If the lost packet is shorter than the estimated pitch period, then the generated waveform is a fraction of the length of the estimated pitch period. Suitably, the generated waveform is slightly longer than the lost packet, such that it overlaps with the received packets on either side of the lost packet. The overlaps are advantageously used to fade the generated waveform of the lost packet into the received signal on either side thereby achieving smooth concatenation.

The concealment module 206 may generate a waveform using samples of the received signal that are stored sequentially in history buffer 208. Advantageously, the history buffer 208 has a longer length (stores more samples) than the estimated pitch period (measured in samples). The concealment module counts back sequentially, from the most recently received sample in the history buffer, by a number of samples equal to the estimated pitch period. The sample that the concealment module counts back to is taken to be the first sample of the generated waveform. The concealment module 206 takes sequential samples up to the number of samples that are in the lost packet. The resulting selected set of samples is taken to be the generated waveform. For example, if the history buffer has a length of 200 samples, the estimated pitch period is determined to have a length of 50 samples and the lost packet has a length of 30 samples, then the concealment module 206 generates a waveform containing samples 151 to 180 of the history buffer.

If the lost packet is longer than the estimated pitch period, then the set of samples equal to the length of the estimated pitch period is selected (in the above example this would be samples 151 to 200). This set of samples is repeated and used as the generated waveform to replace the lost packet. Alternatively, a set of samples equal to the length of the lost packet is selected from the history buffer 208. This is achieved by counting back sequentially in the history buffer, from the most recently received sample, by a number of samples equal to a multiple of the estimated pitch period. The multiple is chosen such that the number of samples counted back is longer than the length of the lost packet. Typically this will be 2 or 3 times the estimated pitch period. The sample that the concealment module counts back to is taken to be the first sample of the generated waveform. The concealment module 206 takes sequential samples up to the number of samples that are in the lost packet. The resulting selected set of samples is taken to be the generated waveform. For example, if the history buffer has a length of 200 samples, the estimated pitch period is determined to have a length of 50 samples and the lost packet has a length of 60 samples, then the concealment module 206 generates a waveform containing samples 101 to 160 of the history buffer.

Alternatively, other known pitch based waveform substitution techniques utilizing the estimated pitch period may be used by the concealment module 206.

Whilst the pitch period estimation module 202 is estimating the pitch period of a first frame of the signal, a second frame of the speech signal is input into the voice detection module 201 and classified as either voiced or unvoiced.

In the calibration mode, the pitch periods of voiced frames of data estimated by the pitch period estimation module 202 are outputted to circuitry arranged to calculate the median of the estimated pitch periods.

Preferably the circuitry arranged to calculate the median of the estimated pitch periods implements a partition based selection algorithm. The pitch period estimation module 202 outputs the estimated pitch period of the first voiced frame to a buffer 203. The buffer stores the estimated pitch period. If the second frame is voiced then it is output by the voice detection module 201 to the pitch period estimation module 202 which estimates its pitch period and outputs the estimation to the buffer. This process repeats for subsequent frames of the signal until the buffer has reached capacity, i.e. until it is storing a number of estimated pitch periods equal to its maximum length. In general, a longer buffer will result in a more accurate pitch range estimate for the signal, but at the cost of a higher computational load and higher memory consumption. Suitably, the buffer length is computed by:

$$L_b = t_{max} \times \frac{F_s}{I_s} \qquad \text{(equation 2)}$$

where $L_b$ is the buffer length, $t_{max}$ is the maximum voicing duration required, $F_s$ is the sampling rate and $I_s$ is the block processing interval measured in numbers of samples. For example, for a typical maximum voicing duration of 1 second, a sampling rate of 8 kHz and a block processing interval of 64, the buffer length is 125 samples according to equation 2.

When the buffer 203 reaches capacity, the median of the estimated pitch periods stored in it is calculated by the median determination module 204. The pitch period estimates are sorted and the middle value selected as the median. Generally, sorting n items takes of the order of (n log n) operations. A partition based selection algorithm reduces this to of the order of n operations. A suitable partition based selection algorithm to be implemented in the median determination module 204 is the select algorithm (see William Press, Saul Teukolsky, William Vetterling and Brian Flannery, *Numerical Recipes in C.The Art of Scientific Computing*, $2^{nd}$ edition, 1992, Chapter 8, page 341-345). After the median of the estimated pitch periods has been calculated, the buffer contents are emptied in preparation for receiving the next set of estimated pitch periods during the next calibration process. The median determination module 204 outputs the calculated median pitch period to the pitch period range adaptation module 205.

Alternatively, the circuitry arranged to calculate the median of the estimated pitch periods may do so 'on the fly'. In this case a buffer is not used. The pitch period estimation module 202 outputs estimated pitch periods to the median determination module 204. The median determination module 204 estimates the median pitch period on receipt of the first estimated pitch period and re-evaluates this median pitch period on receipt of each further estimated pitch period during the calibration mode. The Fast Algorithm for Median Estimation (FAME) is an example of an algorithm that could be suitably implemented by the median determination module 204. FAME calculates the median of input samples that are received 'on the fly'. Only two double precision variables need to be stored and the computation is linear in the number of samples with a small constant. Advantageously, this method reduces memory consumption compared to a partition based selection algorithm because the estimated pitch periods are not stored in a buffer. However, the number of data samples required for convergence of the estimated median value to the true median value depends on the quality of the data. If the quality of the data is low (i.e. there are a large number of outliers) the convergence rate is slow.

As an alternative to determining the median of the estimated pitch periods, an alternative averaging process can be used. For example, the mean of the estimated pitch periods can be determined. It takes of the order of n operations to calculate the mean of n values. The mean (or any other average) can be used instead of the median in the method and apparatus described below. The median is, however, the preferable average to use because it is more robust in the presence of outlier values than the mean. In dependence on the median pitch period received from the median determination module 204, the pitch period range adaptation module 205 determines a refined pitch period range to be used by the pitch period estimation module 202 in estimating the pitch periods of further voiced frames of the signal. Advantageously, the end values of the refined pitch period range are defined proportional to the median pitch period. For example, the refined pitch period range may be chosen to lie in the range $[0.67P_m, 1.5P_m]$, where $P_m$ is the median pitch period. Generally, the refined pitch period range is encompassed by the original pre-defined pitch period range. The refined pitch period range is much narrower than the pre-defined pitch period range.

The pitch period range adaptation module 205 outputs the refined pitch period range to the pitch period estimation module 202. On receipt of the refined pitch period range by the pitch period estimation module 202, the calibration mode is disabled thereby enabling the normal mode. The calibration mode may be disabled by opening a switch 207 between the output of the pitch period estimation module 202 and the buffer 203. Opening the switch 207 prevents the pitch period estimation module 202 from outputting estimated pitch periods to the buffer. The feedback loop to the pitch period estimation module is thereby disabled.

In the normal mode of operation, the pitch period estimation module 202 estimates the pitch periods of voiced frames of data using the refined pitch period range calculated during the previous calibration process. In the normal mode of operation, the pitch period estimation module 202 outputs the estimated pitch periods to the concealment module 206. The concealment module 206 operates in the same manner as it does in the calibration mode. In the normal mode, the feedback loop to the pitch period estimation module 202 is disabled, for example by the switch 207 being open.

The pitch period estimation apparatus operates in the calibration mode when it first receives a voice signal. After the calibration it operates in the normal mode. Preferably, the calibration mode is entered periodically during the receipt of the voice signal. Suitably, the calibration is carried out at regular time intervals during receipt of the voice signal.

Generally speaking, the pitch period of a given human voice does not vary significantly over time. However variations in the pitch period of a voice may be significant enough to occasionally fall out of the refined pitch period range determined in the calibration mode. If the true pitch period is shorter than the lower end value of the range (for example $0.67P_m$ in the example range above) then the estimated pitch period is likely to be twice the true period (this corresponds to the pitch halving condition as described in the background to this disclosure) or a higher integer multiple of the true pitch period. Use of a pitch period in a packet loss concealment technique that is an integer multiple of the true period can still result in a reasonable quality output voice signal. However, if the true pitch period is longer than the higher end value of the refined pitch period range (for example $1.5P_m$ in the example range above) then the estimated pitch period is likely to be a fraction of the actual pitch period, which corresponds to the pitch doubling condition. If this happens, pitch based waveform substitution may actually produce worse results than alternative simpler approaches, such as repeating previous segments or silence insertion.

To avoid severe distortion which may be caused by substituting a pitch based waveform with an incorrect pitch period for a lost packet, metrics can be used to check if the substitute is a good fit. One such metric is to calculate the "join cost" at the concatenation boundary. In this metric, pattern matching between the substitute waveform and the previous frame of received data is used to determine if the substitute is a good fit. If the substitute is determined not to be a good fit then a non-pitch based waveform substitution may be used instead.

The refined pitch period range may be further adjusted based on specific needs. For example, the low bound (0.67Pm) and high bound (1.5Pm) can be adjusted to span a wider or narrower range.

Suitably, a history buffer is also associated with the voice detection module 201 or the pitch period estimation module 202. This history buffer may be the same as history buffer 208 associated with the concealment module 206.

FIG. 2 is a schematic diagram of the pitch period estimation apparatus described herein. The method described does not have to be implemented at the dedicated blocks depicted in FIG. 2. The functionality of each block could be carried out by another one of the blocks described or using other apparatus. For example, the method described herein could be implemented partially or entirely in software.

Figure 3:
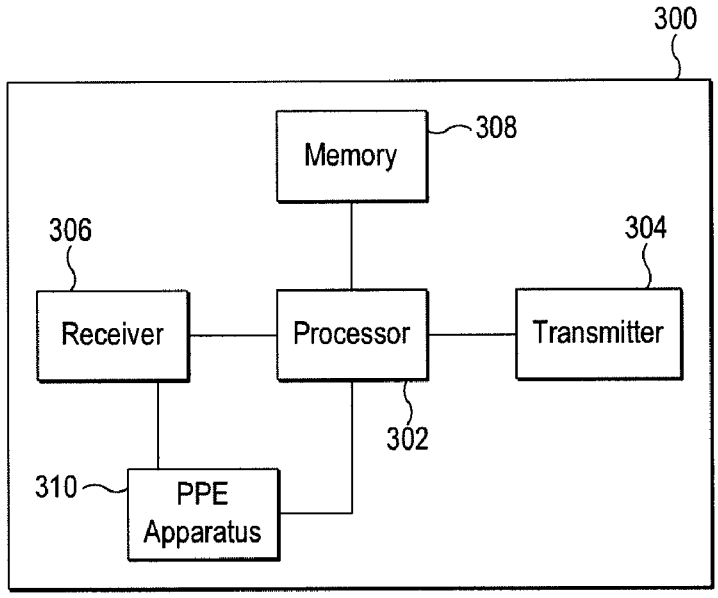
FIG. 3 is a schematic diagram of a transceiver suitable for comprising the pitch period estimation apparatus of FIG. 2.

The pitch period estimation apparatus of FIG. 2 could usefully be implemented in a handheld transceiver. FIG. 3 illustrates such a transceiver 300. A processor 302 is connected to a transmitter 304, a receiver 306, a memory 308 and a pitch period estimation apparatus 310. Any suitable transmitter, receiver, memory and processor known to a person skilled in the art could be implemented in the transceiver. Preferably, the pitch period estimation apparatus 310 comprises the apparatus of FIG. 2. The pitch period estimation apparatus is additionally connected to the receiver 306. The signals received and demodulated by the receiver may be passed directly to the pitch period estimation apparatus for pitch period determination. Alternatively, the received signals may be stored in memory 308 before being passed to the pitch period estimation apparatus. The handheld transceiver of FIG. 3 could suitably be implemented as a wireless telecommunications device.

Figure 1:
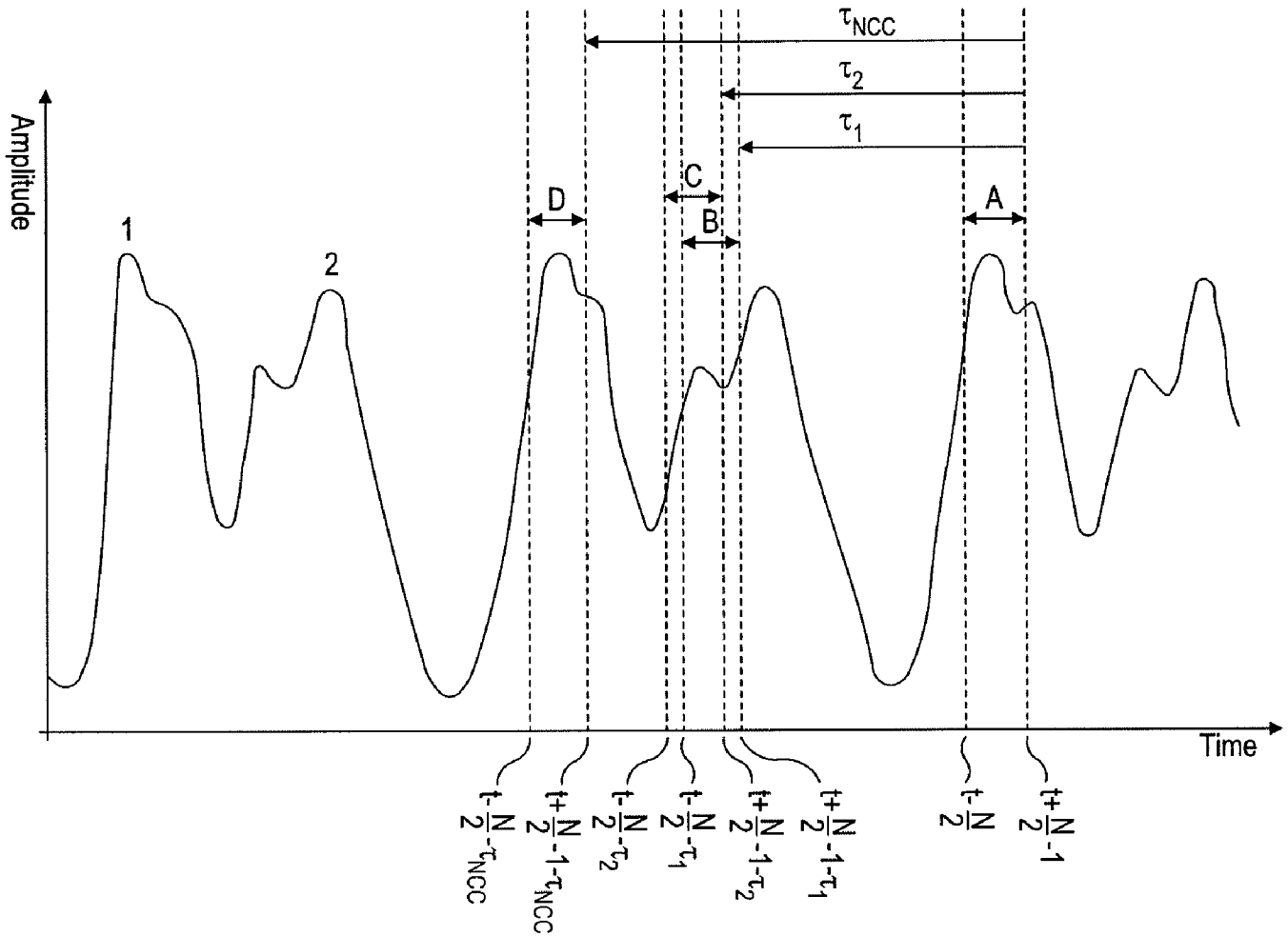
FIG. 1 is a graph of a typical voice signal illustrating a cross-correlation method.

The method and apparatus described herein reduces the computational complexity associated with estimating the pitch period of a signal by reducing the number of calculations that the pitch period estimating algorithm computes. In known systems, pitch period estimating algorithms scan over a wide pre-defined pitch period range to find an estimate of the pitch period. A wide pre-defined pitch period range is used because human voices have pitch periods varying over a wide range. The method described herein uses an initial calibration procedure which estimates the pitch period of a voice signal using a wide pitch period range and uses the estimation to define a narrower refined pitch period range. The narrower pitch period range is used in estimating the pitch period of subsequent portions of the voice signal. In an NCC method, using a narrower pitch period range reduces computational complexity by reducing the number of lag values $\tau$ over which the correlation is computed. In FIG. 1, this corresponds to reducing the number of further segments (B, C, D) with which the first segment (A) is correlated.

The described method is effective for the following reasons. A voice signal is substantially stationary over short time intervals therefore the pitch period of the signal tends not to vary substantially over such intervals. If the pitch period of the signal is not initially known then it is found by scanning over a wide pitch period range. Once the pitch period has been initially found, it is only necessary to scan over a narrow interval around that initial value to find it for subsequent frames of the voice signal. The method described can be seen as a personalization or speaker adaptation process.

The method described is useful for packet loss concealment techniques implemented in wireless voice or VoIP communications. Typically in such implementations the speaker does not change. However, if the speaker does change then the narrow pitch period range determined for the initial speaker may not be suitable for the further speaker. The method described herein advantageously periodically repeats the calibration process in which a narrowed pitch period range is determined. If the speaker has changed then a new narrowed pitch period range appropriate for use with the voice signal of the further speaker is determined and used for subsequent frames of the signal. Additionally, it is possible that a single speaker's pitch period may vary significantly such that it falls out of the refined narrowed pitch period range determined during the previous calibration process. Periodic repetition of the calibration process helps to overcome such a problem.

The method described herein determines a refined pitch period range in dependence on the median of pitch period estimations of prior frames of the signal. Any type of average could be used to determine the refined pitch period range. The median is preferably used, however, because it is more robust in the presence of outlier values than, for example, the mean.

The described method is less susceptible to pitch doubling and pitch halving errors than known methods. This is because the refined pitch period range is chosen to be sufficiently narrow that it encompasses the expected pitch period of the subsequent frames of the signal but does not encompass periods that are half the length of the expected pitch period or double the length of the expected pitch period. Since the estimated pitch period is always found to be a value within the pitch period range, by not scanning over a range encompassing half the expected pitch period and/or double the expected pitch period it is less likely that one of these values will be mistaken for the pitch period.

The method described herein provides a pitch period range refinement procedure for use in packet loss concealment systems. Improved pitch period estimation accuracy is achieved in combination with a reduction in the computational complexity of the pitch period estimation. The method is simple to implement, highly configurable, and only requires a small additional use of system resources. It can be used in combination with a number of pitch period estimation algorithms, and can potentially be used in other voice applications in addition to packet loss concealment methods.

The applicant draws attention to the fact that the present disclosure may include any feature or combination of features disclosed herein either implicitly or explicitly or any generalization thereof, without limitation to the scope of any of the present claims. In view of the foregoing description it will be evident to a person skilled in the art that various modifications may be made within the scope of the disclosure.

The invention claimed is:

1. A method of refining a pitch period estimation of a signal, the method comprising:

for each of a plurality of portions of the signal, scanning over a predefined range of time offsets to find an estimate of the pitch period of the portion within the predefined range of time offsets;

identifying, via a computing apparatus, the average pitch period of the estimated pitch periods of the portions;

determining, via the computing apparatus, a refined range of time offsets in dependence on the average pitch period, the refined range of time offsets being narrower than the predefined range of time offsets; and for a subsequent portion of the signal, scanning over the refined range of time offsets to find an estimate of the pitch period of the subsequent portion.

2. A method as claimed in claim 1, wherein said identifying the average pitch period of the estimated pitch periods of the portions comprises identifying the median pitch period of the estimated pitch periods of the portions.

3. A method as claimed in claim 1, further comprising detecting voiced and unvoiced segments of the signal, and selecting the plurality of portions of the signal from the voiced segments.

4. A method as claimed in claim 1, wherein said determining comprises selecting the lowest value and highest value of the refined range of time offsets to be proportional to the average pitch period.

5. A method as claimed in claim 4, comprising selecting the lowest value to be 0.67 times the average value, and selecting the highest value to be 1.5 times the average value.

6. A method as claimed in claim 1, further comprising generating a waveform having a pitch period equal to the estimated pitch period of one of the plurality of portions or the subsequent portion, and replacing a lost or corrupted segment of the signal with the waveform.

7. A method as claimed in claim 1, further comprising storing the estimated pitch periods of the plurality of portions of the signal in a buffer as they are found, and identifying the average pitch period when the buffer reaches its storing capacity.

8. A method as claimed in claim 1, wherein for each of the plurality of portions and the subsequent portion, said finding an estimate of the pitch period of the portion comprises:

correlating a first part of the portion of the signal with each of n earlier parts of the portion of the signal, the n earlier parts preceding the first part by respective time offsets; and estimating the pitch period of the portion of the signal to be the time offset at which the correlation is maximal.

9. A method as claimed in claim 1, further comprising estimating the pitch periods of further subsequent portions of the signal by scanning over the refined range of time offsets.

10. A method as claimed in claim 1, further comprising periodically repeating the pitch period estimation refinement method of claim 1 on the signal.

11. A pitch period estimation apparatus, comprising:

a pitch period estimation module configured for each of a plurality of portions of a signal to scan over a predefined range of time offsets to find an estimate of the pitch period of the portion within the range of time offsets;

an average determination module configured to identify, via a computing apparatus, the average pitch period of the estimated pitch periods of the portions; and a time offset range adaptation module configured to determine, via the computing apparatus, a refined range of time offsets in dependence on the average pitch period, the refined range of time offsets being narrower than the predefined range of time offsets;

wherein the pitch period estimation module is further configured for a subsequent portion of the signal to scan over the refined range of time offsets to find an estimate of the pitch period of the subsequent portion.

12. An apparatus as claimed in claim 11, further comprising a voice detection module configured to detect voiced and unvoiced segments of the signal and output the voiced segments to the pitch period estimation module.

13. An apparatus as claimed in claim 11, further comprising a concealment module configured to receive the estimated pitch period of one of the plurality of portions or the estimated pitch period of the subsequent portion from the pitch period estimation module and generate a waveform having a pitch period equal to the received estimated pitch period and replace a lost or corrupted segment of the signal with the waveform.

14. An apparatus as claimed in claim 13, wherein the concealment module is further configured to receive an unvoiced segment from the voice detection module, and replace a lost segment of the signal with the unvoiced segment.

15. An apparatus as claimed in claim 11, further comprising a buffer configured to store the estimated pitch periods of the plurality of portions of the signal.

16. An apparatus, comprising:

a computing device; and memory storing software configured to instruct the computing device to:

for each of a plurality of portions of a signal, scan over a predefined range of time offsets to find an estimate of the pitch period of the portion within the predefined range of time offsets;

identify the average pitch period of the estimated pitch periods of the portions;

determine a refined range of time offsets in dependence on the average pitch period, the refined range of time offsets being narrower than the predefined range of time offsets; and for a subsequent portion of the signal, scan over the refined range of time offsets to find an estimate of the pitch period of the subsequent portion.

17. The apparatus of claim 16, further comprising a receiver to receive the signal.

18. The apparatus of claim 16, wherein the memory further stores software configured to instruct the computing device to:

detect voiced and unvoiced segments of the signal, and select the plurality of portions of the signal from the voiced segments.

19. The apparatus of claim 16, wherein the memory further stores software configured to instruct the computing device to:

generate a waveform having a pitch period equal to the estimated pitch period of one of the plurality of portions or the subsequent portion, and replace a lost or corrupted segment of the signal with the waveform.

20. The apparatus of claim 19, wherein the memory further stores software configured to instruct the computing device to:

find an estimate of the pitch period of the portion by correlating a first part of the portion of the signal with each of n earlier parts of the portion of the signal, the n earlier parts preceding the first part by respective time offsets; and estimate the pitch period of the portion of the signal to be the time offset at which the correlation is maximal.

21. A wireless telecommunications device, comprising:

a receiver to receive a signal;

a transmitter;

a computing device; and memory storing software configured to instruct the computing device to:

for each of a plurality of portions of the signal, scan over a predefined range of time offsets to find an estimate or the pitch period of the portion within the predefined range of time offsets;

identify the average pitch period of the estimated pitch periods of the portions;

determine a refined range of time offsets in dependence on the average pitch period, the refined range of time offsets being narrower than the predefined range of time offsets; and for a subsequent portion of the signal, scan over the refined range of time offsets to find an estimate of the pitch period of the subsequent portion.

22. A pitch period estimation apparatus, comprising:

a pitch period estimation circuit configured for each of a plurality of portions of a signal to scan over a predefined range of time offsets to find an estimate of the pitch period of the portion within the range of time offsets;

an average determination circuit configured to identify the average pitch period of the estimated pitch periods of the portions; and a time offset range adaptation circuit configured to determine a refined range of time offsets in dependence on the average pitch period, the refined range of time offsets being narrower than the predefined range of time offsets;

wherein the pitch period estimation circuit is further configured for a subsequent portion of the signal to scan over the refined range of time offsets to find an estimate of the pitch period of the subsequent portion.

23. An apparatus as claimed in claim 22, further comprising a voice detection circuit configured to detect voiced and unvoiced segments of the signal and output the voiced segments to the pitch period estimation circuit.

24. An apparatus as claimed in claim 22, further comprising a concealment circuit configured to receive the estimated pitch period of one of the plurality of portions or the estimated pitch period of the subsequent portion from the pitch period estimation circuit and generate a waveform having a pitch period equal to the received estimated pitch period and replace a lost or corrupted segment of the signal with the waveform.

25. An apparatus as claimed in claim 24, wherein the concealment circuit is further configured to receive an unvoiced segment from the voice detection circuit, and replace a lost segment of the signal with the unvoiced segment.

26. An apparatus as claimed in claim 22, further comprising a buffer configured to store the estimated pitch periods of the plurality of portions of the signal.

* * * * *

UNITED STATES PATENT AND TRADEMARK OFFICE

CERTIFICATE OF CORRECTION

PATENT NO. : 8,214,201 B2
APPLICATION NO. : 12/274061
DATED : July 3, 2012
INVENTOR(S) : Xuejing Sun It is certified that error appears in the above-identified patent and that said Letters Patent is hereby corrected as shown below:

In Column 2, line 26, delete "$\rho_2$" and insert -- $\tau_2$ --.

In Column 13, line 20, in Claim 21, delete "or the" and insert -- of the --.

Signed and Sealed this
Eighteenth Day of September, 2012

David J. Kappos

David J. Kappos
*Director of the United States Patent and Trademark Office*